United States Patent [19]

Mercier et al.

[11] 4,404,025

[45] Sep. 13, 1983

[54] PROCESS FOR MANUFACTURING SEMIFINISHED PRODUCT FROM A MEMORY ALLOY CONTAINING COPPER

[75] Inventors: Olivier Mercier; Dag Richter, both of Ennetbaden; Günther Schröder, Birmenstorf, all of Switzerland

[73] Assignee: BBC Brown, Boveri & Company Limited, Baden, Switzerland

[21] Appl. No.: 351,530

[22] Filed: Feb. 23, 1982

[30] Foreign Application Priority Data

Mar. 13, 1981 [CH] Switzerland ..... 1728/81

[51] Int. Cl.[3] ..... C21D 8/00

[52] U.S. Cl. ..... 148/11.5 F; 148/11.5 N

[58] Field of Search ..... 148/11.5 N, 11.5 F, 148/11.5 R

[56] References Cited

U.S. PATENT DOCUMENTS 4,144,057 10/1982 Melton et al. ..... 148/11.5

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

Brittle Ni/Ti memory alloys containing copper can be transformed, from the cast condition, into semifinished product which is suitable for further processing, by a process in which a cast bar is homogenized, a little below the solidus line, and is then isothermally extruded in the temperature range from 700° to 850° C.

7 Claims, No Drawings

PROCESS FOR MANUFACTURING SEMIFINISHED PRODUCT FROM A MEMORY ALLOY CONTAINING COPPER

BACKGROUND OF THE INVENTION

1. Field of the Invention

The starting point of the invention is a process for manufacturing semifinished product from a memory alloy of the Ni/Ti type containing Cu.

2. Description of the Prior Art

The hot-working of memory alloys based on nickel and titanium is a process which is already generally known. A respectable body of literature already exists concerning the forging, swaging, rolling and drawing of these alloys (e.g. C. M. Jackson, H. J. Wagner and R. J. Wasilewski, 55-Nitinol-The alloy with a memory: its physical metallurgy, properties and applications, NASA SP5110, p. 19–21; U.S. Pat. No. 3,508,914; U.S. Pat. No. 3,700,434). The extrusion of nickel/titanium alloys has likewise been reported (J. H. Hanlon, S. R. Butler, R. J. Wasilewski, Effect of martensitic transformation on the electrical and magnetic properties of NiTi, Trans. Met. Soc. of AIME, 239, p. 1323, 1967). Various extrusion methods were used in the course of the above work, which was carried out at 900° C., and with reduction ratios of 4:1 to 16:1.

These processes have been developed virtually exclusively for binary nickel/titanium alloys, and are unsuitable for ternary alloys containing copper, particularly when the copper contents are comparatively high. The ternary alloys, of the Ni/Ti/Cu type, are significantly more brittle, and contain higher proportions of the secondary phase, and greater proportions of pores, then binary Ni/Ti alloys. They accordingly impose far more exacting requirements on the methods of working. Since alloys of this type are of great industrial significance, there is a keen need for suitable production processes.

SUMMARY OF THE INVENTION

The object underlying the invention is to indicate a process for manufacturing semifinished product from ternary Ni/Ti/Cu alloys, which process delivers dense and defect-free products.

This object is achieved, according to the invention, by means of a process for manufacturing semifinished product from a memory alloy of the Ni/Ti type, containing copper, starting from a cast bar, wherein the cast bar is subjected to a homogenizing annealing treatment, for 1 to 200 hours, at a temperature which is 10°–200° C. below the solidus temperature of the alloy, cooled, machined, coated with a lubricant, and isothermally extruded at a temperature of 700° to 850° C., using a ram speed of at least 0.01 mm/s, a conically shaped extrusion die with rounded-off edges, and a reduction ratio of 4:1 to 20:1.

ILLUSTRATIVE EMBODIMENT

First of all, the round bar was cast, using conventional processes, from a ternary memory alloy having the composition specified below.

Titanium: 44.7% by weight

Nickel: 29.3% by weight

Copper: 26% by weight

The components were initially purified, in the elementary form, dried, and melted down in a graphite crucible, in vacuo, together with an alloy which has been premelted on the bottom of the crucible. The melt was cast into a graphite mold, producing a cast bar, 20 mm in diameter and 140 mm long. The cast bar was subjected to a homogenizing annealing treatment, a little below the solidus line, in the present case at a temperature of 900° C., for 24 hours, under an argon atmosphere. A piece was severed from the cast, homogenized bar, and this piece was turned down to a diameter of 18 mm and a length of 35 mm. This diameter was slightly less than the internal diameter of the receiver of the extrusion press. To obtain a suitable carrier for the film of lubricant, to be applied afterwards, the workpiece was held for 10 minutes at a temperature of 700° C., a thin oxide layer being formed on the surface. Boron nitride was used as the lubricant. Extrusion was carried out isothermally, at a temperature of 750° C., under a ram force of 150 kN, the ram speed being 0.1 mm/s. The extruded strand, thus obtained, had a diameter of 9 mm, corresponding to a reduction ratio of 4:1. An extrusion die was used as the tool, this die having, on the entry side, a conical surface with half the approach angle equal to 45° and an axial length of 4.5 mm and, on the exit side, a cylindrical portion having a diameter of 9 mm and an axial length of 5 mm. A radius of 5 mm was present at the entry of the conical portion, and a radius of 2 mm was present at the exit.

The extruded strand (semifinished product), 9 mm in diameter, was encapsulated in a steel tube with a wall thickness of 1 mm, and was swaged, at 750° C., to a diameter of 3 mm. The steel jacket was thereupon removed and the wire was drawn down, cold, to a diameter of 1 mm, in several steps. The reduction in cross-section, per step, was 10% on each occasion. Between two steps, the wire was subjected to intermediate annealing for 15 minutes, at 800° C. The finished wire was finally subjected to a soft-annealing process at 900° C., for one hour, to obtain the preconditions, with respect to its microstructure, for optimum formation of martensite at a later stage.

The present process for manufacturing semifinished product is directed towards the memory-alloy composition which can fundamentally be described as follows:

Titanium: 43 to 46.5% by weight

Copper: 0.5 to 30% by weight

Nickel: Remainder

The homogenizing annealing of the cast bar can be carried out, for 1 to 200 hours at temperatures which are 10° to 200° C. below the solidus line of the alloy. The hot-working, by extrusion, can be carried out isothermally, in the temperature range from 700° to 850° C., at ram speeds of 0.01 mm/s and higher. The reduction ratio can be 4:1 to 20:1. The extrusion die used should have a conical portion with, preferably, half the approach angle equal to 45° , the transition radius into this portion, from the receiver, preferably being 1 to 10 mm or 1 to 25% of the diameter of the receiver. The corresponding transition radius at the exit of the conical portion of the die, into the cylindrical portion of the die, should also preferably be 1 to 10 mm, or 1 to 25% of the diameter of the receiver. The cylindrical portion of the die (exit) should be longer in the axial direction than the conical portion (entry).

It is self-evident that, to suit the practical requirements, the tools used for the isothermal extrusion operation can also have dimensions other than those mentioned above. This also applies, above all, to the design of the extrusion die, the shape of which moreover depends, to a certain degree, on the profile to be produced (whether round, triangular, square, rectangular, hollow, strip-shaped, etc.).

There is no theoretical upper limit to the extrusion speed, provided only that the condition that the deformation process be isothermal is complied with. An upper limit is fixed only by practical factors, and depends, in turn, on the dimensions of the extrusion slug, the profile to be produced, the size of the extrusion press, the alloy composition, etc.

The surface-oxidation process for facilitating the application of the lubricant, mentioned in the example, can even be omitted, and is not essential to the invention.

The process according to the invention enables semifinished product to be manufactured, in a simple manner, from the brittle Ni/Ti/Cu alloy, even when the copper contents are comparatively high, this alloy being intrinsically difficult to deform.

We claim:

1. A process for manufacturing semifinished product comprising the steps of forming a memory alloy consisting of the Ni/Ti type, containing copper, starting from a cast bar, subjecting said cast bar to a homogenizing annealing treatment, for 1 to 200 hours at a temperature which is 10° to 200° C. below the solidus temperature of the alloy cooling machining, coating with a lubricant, and isothermally extruding at a temperature of 700° to 850° C., using a ram speed of at least 0.01 mm/s, a conically shaped extrusion die with rounded-off edges, and a reduction ratio of 4:1 to 20:1.

2. The process as claimed in claim 1, wherein half the approach angle of the conical portion of the extrusion die equals 45°.

3. The process as claimed in claim 1, wherein the transition radius of the entry into the conical portion of the extrusion die is 1 to 10 mm, or 1 to 25% of the diameter of the receiver of the extrusion press, and wherein the transition radius of the exit of the conical portion of the extrusion die, into the cylindrical portion of the die, is 1 to 10 mm, or 1 to 25% of the diameter of the receiver.

4. The process as claimed in claim 1, wherein the cylindrical portion of the die is longer than the conical portion, measured in the longitudinal direction.

5. The process as claimed in any one of claims 1 to 4, wherein the reduction ratio measures 4:1, the diameter of the receiver measures 18 mm, the radii at the entry to and exit from the conical portion of the extrusion die respectively measure 5 mm and 2 mm, and the axial lengths of the conical and cylindrical portions of the extrusion die respectively measure 4.5 mm and 5 mm.

6. The process as claimed in claim 1, wherein the memory alloy is composed of 43 to 46.5% by weight of Ti and 0.5 to 30% by weight of Cu, the remainder being Ni.

7. The process as claimed in claim 1, wherein the memory alloy is composed of 44.7% by weight of Ti, 29.3% by weight of Ni, and 26% by weight of Cu, wherein it is homogenized at 900° C. for 24 hours, under an argon atmosphere, machined, surface-oxidized at 700° C. for 10 minutes, and coated with a layer of lubricant, composed of BN, and wherein the extrusion slug, produced in this manner, is isothermally extruded at 750° C., at a ram speed of 0.1 mm/s and an extrusion force of 150 kN, in an extrusion press having a receiver with a diameter of 18 mm.

* * * * *